US006196319B1

(12) United States Patent
Henskens et al.

(10) Patent No.: US 6,196,319 B1
(45) Date of Patent: Mar. 6, 2001

(54) HYDRAULIC SAND REMOVAL TOOL

(75) Inventors: Rudolf Antonius Henskens, Whitecairns; David Brands, Aberdeen, both of (GB)

(73) Assignee: Western Atlas International, Inc., Houston, TX (US)

( * ) Notice: Subject to any disclaimer, the term of this patent is extended or adjusted under 35 U.S.C. 154(b) by 0 days.

(21) Appl. No.: 09/336,573

(22) Filed: Jun. 21, 1999

(30) Foreign Application Priority Data

Oct. 15, 1998 (GB) ..... 9822526

(51) Int. Cl.[7] ..... E21B 27/00
(52) U.S. Cl. ..... 166/311; 166/163; 166/167
(58) Field of Search ..... 166/311, 107, 166/108, 162, 163, 164, 165, 167, 168, 105.3

(56) References Cited

U.S. PATENT DOCUMENTS

| | | | | |
|---|---|---|---|---|
| Re. 34,451 | | 11/1993 | Donovan et al. | 166/55.1 |
| 2,992,682 | * | 7/1961 | Yates | 166/107 |
| 3,900,074 | | 8/1975 | Lee | 175/242 |
| 4,190,113 | * | 2/1980 | Harrison | 166/107 X |
| 4,623,022 | | 11/1986 | Chakrabarty et al. | 166/310 |
| 4,681,163 | | 7/1987 | Guidry et al. | 166/278 |
| 4,940,092 | * | 7/1990 | Ferguson | 166/311 |
| 5,036,920 | | 8/1991 | Cornette et al. | 166/278 |
| 5,076,355 | | 12/1991 | Donovan et al. | 166/55.1 |
| 5,095,976 | * | 3/1992 | Appleton | 166/107 |
| 5,139,089 | * | 8/1992 | Wacker | 166/311 |
| 5,224,548 | | 7/1993 | Dankovich, II | 166/311 |
| 5,327,974 | | 7/1994 | Donovan et al. | 166/311 |
| 5,944,100 | * | 8/1999 | Hipp | 166/311 |

* cited by examiner

*Primary Examiner*—David Bagnell
*Assistant Examiner*—Kamal Dawelbeit
(74) *Attorney, Agent, or Firm*—Darryl M. Springs

(57) ABSTRACT

An apparatus and method for removing sand and other debris from a wellbore. The apparatus is particularly suited for wireline operation, and requires minimal surface equipment. A housing is lowered into the wellbore until the housing is proximate to the sand, and a valve is opened to permit entry of the sand into a housing chamber. The housing can be raised to the wellbore surface so that the sand can be removed from the housing chamber. In one embodiment of the invention, the housing has two chambers each having a floating piston. A liquid is initially retained within the first chamber and is pressurized as the housing is lowered into the wellbore. Activation of a valve and differential pressures acting across the first piston move the liquid into the second chamber and draw the sand into the first chamber. The second chamber captures the liquid and facilitates return of the pistons to the initial position after the sand is emptied from the first chamber.

16 Claims, 2 Drawing Sheets

HYDRAULIC SAND REMOVAL TOOL

CROSS-REFERENCE TO RELATED APPLICATIONS

Not Applicable.

BACKGROUND OF THE INVENTION

1. Field of the Invention

The present invention relates to the field of sand and other solids removal from wellbores. More particularly, the invention relates to an apparatus and method for hydraulic withdrawal of sand and other solids into a housing for wireline removal from a wellbore.

2. Description of Related Prior Art

Sand and other solid particulate materials are produced from certain subsurface geologic formations into a wellbore. The sand can accumulate within the wellbore to restrict fluid production and to prevent movement of workover and other well tools within the wellbore. Well screens and gravel packing techniques restrict sand movement into the wellbore, however these techniques are expensive and do not fully prevent sand migration into the wellbore. Representative examples of such techniques are disclosed in U.S. Pat. No. 4,623,022 to Chakrabarty et al. (1986), in U.S. Pat. No. 4,681,163 to Guidry et al. (1987), in U.S. Pat. No. 5,036,920 to Cornette et al. (1991), and U.S. Pat. No. 5,076,355 to Donovan et al. (1991), reissued 1993 as RE 34,451.

Other tools have been developed for removing debris from wellbores. U.S. Pat. No. 5,224,548 to Dankovich et al. (1993) disclosed an auger for clearing and retrieving debris from a wellbore. U.S. Pat. No. 5,327,974 to Donovan et al. (1994) disclosed another technique for increasing the fluid velocity to entrain debris for removal from a wellbore. Other techniques use pressure washing and fluid jet techniques to wash sand from the interior of a wellbore, or use coiled tubing tools to clear blocked wellbores.

Although coiled tubing tools effectively remove sand and other debris from wellbores, coiled tubing operation is expensive and requires significant equipment. A wireline sand removal tool was disclosed in U.S. Pat. No. 3,900,074 to Lee (1975), wherein a rotatable bit operated with an inner and outer tube to capture wellbore sand for removal to the well surface. The mechanical operation of such tool limits the reliability of this technique, and can fail due to wear on the mechanical components. A need, therefore, exists for an improved apparatus and technique for removing sand from wellbores.

BRIEF SUMMARY OF THE INVENTION

The present invention provides an apparatus for removing debris from downhole in a wellbore to the surface. The apparatus comprises a housing moveable within the wellbore to a location proximate to the debris, a chamber within said housing for receiving the debris, a pressure reducing means for reducing the pressure within said chamber to draw the debris into said chamber, and means for moving said housing, chamber, and debris to the wellbore surface. In other embodiments of the invention, a pressurized liquid can be located within said first chamber and a second chamber can be located within said housing, and a valve can selectively release said pressurized liquid from said first chamber into said second chamber for drawing the debris into said first chamber.

The method of the invention is practiced by lowering the housing within the wellbore to a location proximate to the debris, by operating a pressure reducing means to reduce the pressure within said chamber and to draw the debris into said chamber, and by raising said housing and debris to the wellbore surface.

DETAILED DESCRIPTION OF THE INVENTION

Figure 1:
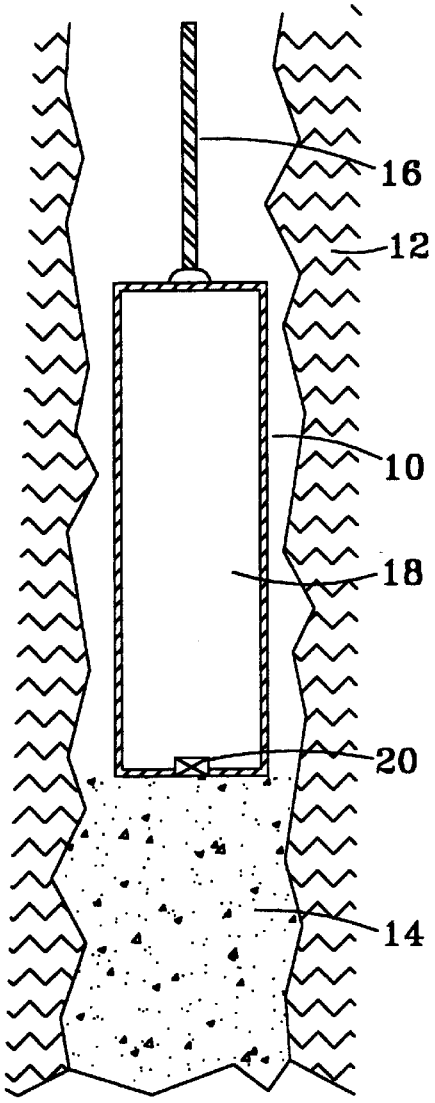
FIG. 1 illustrates a chamber within a housing for retaining sand captured downhole in a wellbore.

The present invention provides a unique apparatus and method for removing debris such as sand from downhole in a wellbore. The lower end of such wellbores is typically filled with a pressurized liquid produced from adjacent geologic formations. As shown in FIG. 1, housing 10 is located in wellbore 12 and can be lowered to a position proximate to sand 14. Although movement of housing 10 can be made with wireline 16, coiled tubing or other devices can be used to move housing 10 within wellbore 12. The primary advantage of wireline 16 is that such technique is inexpensive, highly mobile, and is sufficiently flexible to minimize disruption of other operations in the wellbore. For this reason, the invention provides functional and cost advantages over coiled tubing sand removal systems.

Housing 10 includes chamber 18 and valve 20. Housing 10 can be configured to operate with a CCL Jar and Sinker Bars (not shown) if required to move housing 10 downwardly into wellbore 12. Chamber 18 is initially empty and valve 20 is closed as housing 10 is lowered into a position proximate to sand 14. Valve 20 can be opened so that sand 14 flows into the lower pressure zone within chamber 18. Valve 20 can then be closed to retain sand 14 within chamber 18 as housing 10 is raised to the surface of wellbore 12. Valve 20 can be opened to release sand 14 from within chamber 18, and housing 10 can be relowered into wellbore 12 to continue the sand removal process.

Figure 2:
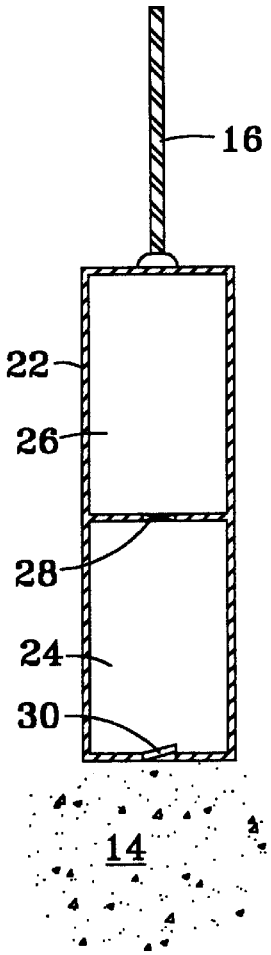
FIG. 2 illustrates a two chamber housing.

FIG. 2 illustrates another embodiment of the invention wherein housing 22 has first chamber 24 and second chamber 26. Valve 28 is positioned between such chambers and is initially closed, and flapper valve 30 is located at the lower end of chamber 24. First chamber 24 is initially at atmospheric pressure, and this pressure will be lower than a fluid pressure downhole in wellbore 12. Housing 22 is lowered with wireline 16 into a position proximate to sand 14, and valve 28 is opened to expose sand 14 to the lower pressure within first chamber 24 and second chamber 26. By opening valve 28, sand 14 is drawn into first chamber 24 until the pressure within wellbore 12 and second chamber 26 is equalized. Housing 22 can be raised to the surface of wellbore 12, and flapper valve 30 retains sand 14 within first chamber 24.

Figure 3:
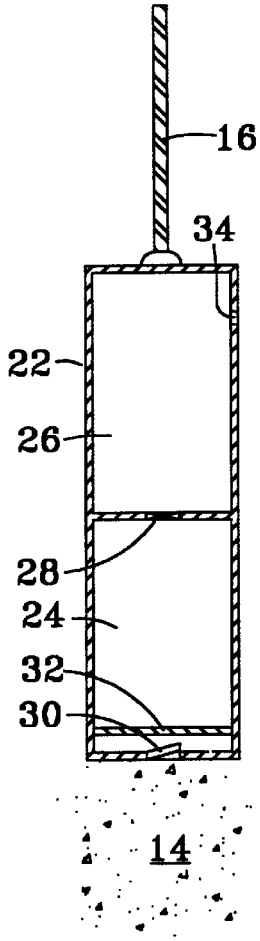
FIG. 3 illustrates a piston within a chamber for preventing intrusion of sand into the other chamber.

To prevent the intrusion of sand 14 into second chamber 26, piston 32 can be positioned within first chamber 24 as illustrated in FIG. 3. Piston 32 moves until the pressure differentials equalize, while preventing the intrusion of sand 14 into second chamber 26. After housing 22 is raised to the surface of wellbore 12 and sand 14 is removed from first chamber 24, compressed air or a pressurized fluid can be injected into port 34 to move piston 32 downwardly into the initial position within first chamber 24.

Figure 4:
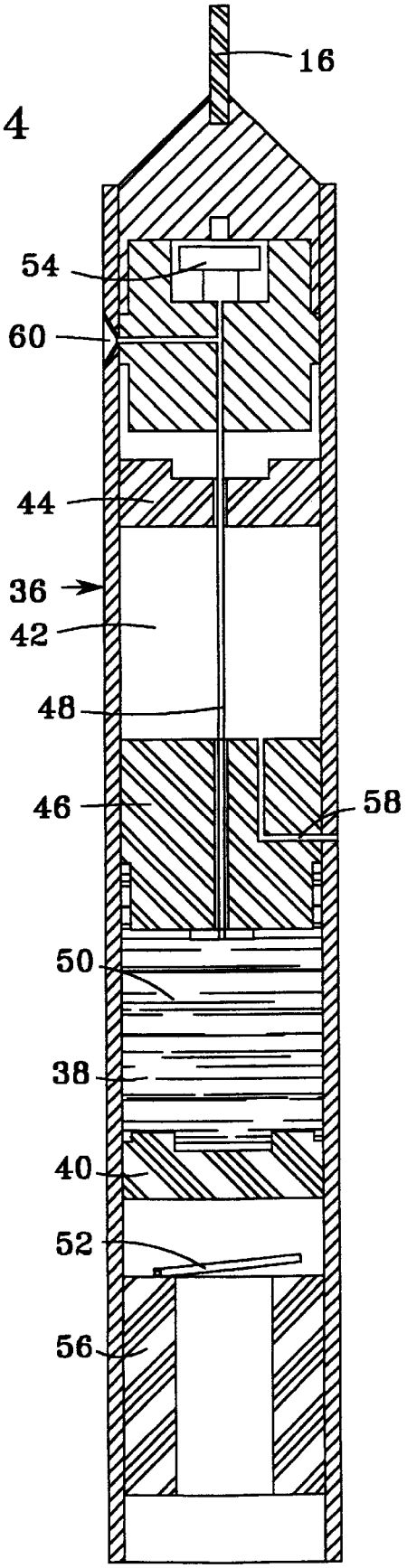
FIG. 4 illustrates a two chamber housing each having respective pistons and a liquid displaceable from one chamber to the other.

In another embodiment of the invention as illustrated in FIG. 4, housing 36 includes first chamber 38 having first piston 40 and second chamber 42 having second piston 44. First chamber 38 and second chamber 42 are separated with sub 46, and are in fluid communication through tube 48 having ends which extend between first chamber 38 and second chamber 42. A hydraulic oil or similar liquid 50 is initially positioned within first chamber 38, between the piston 40 and sub 46. Spring loaded flapper valve 52 prevents fluid intrusion into first chamber 38 between the piston 40 and bottom sub 56 as housing 36 is lowered into wellbore 12.

A valve such as solenoid valve 54 is initially closed to prevent movement of liquid 50 through tube 48. As housing 36 is lowered into the bottom of wellbore 12 and into a position proximate to sand 14, the pressure of liquid 50 within second chamber 38 will increase. When solenoid valve 54 is actuated to open tube 48, the pressurized liquid 50 will evacuate first chamber 38, thereby causing first piston 40 to move upwardly. During this process, sand 14 is drawn into first chamber 38 through flapper valve 52 between the bottom sub 56 and the first piston 40. Simultaneously pressurized liquid 50 moves through tube 48 from between the first piston 40 and the middle sub 46 into the second chamber 42 between the second piston 44 and the upper end sub. This movement causes second piston 44 to move downwardly through second chamber 42 so that liquid 50 is contained within second chamber 42 and is not released into wellbore 12. When the pressures within first chamber 38 and second chamber 42 equalize, flapper valve 52 closes to retain sand 14 within first chamber 38. Closure of flapper valve 52 can occur due a spring or due to the weight of sand 14 above flapper valve 52.

After housing 36 is raised with wireline 16 to the wellbore 12 surface, flapper valve 52 can be opened to release sand 14 from first chamber 38. This can be accomplished by opening flapper valve 52, by removing sub 56 from housing 36, or with other techniques. First piston 40, second piston 44, and liquid 50 are returned to the initial positions by injecting compressed air or pressurized liquid into second chamber 42 through port 58. The force exerted by such injection moves second piston 44 toward the initial position as solenoid valve 54 is opened, thereby permitting liquid 50 to exit second chamber 42 and to return to first chamber 38. Alternatively, operation of manual valve 60 can cause the pressurized liquid 50 within second chamber 42 to move first piston 40 toward the initial position relative to first chamber 38. In either event, the return of liquid 50 moves first piston 40 toward the initial position, thereby preparing the apparatus for another wireline run.

The present invention is applicable for the removal of debris and contaminants from vertical, slanted or horizontal wellbores. Although the housing can be lowered until the debris is contacted, actual contact is not necessary to draw the debris into the housing chamber due to the pressure differentials created. The housing can be dropped on top of sand 14 several times to break any rigid crust formed on the top surface, and the valve can be electrically or mechanically actuated. For example, operation of the valve to permit entry of sand into the chamber can be accomplished in response to housing contact with the sand, and other electrical, mechanical, or electromechanical operating mechanisms can be devised to accomplish the function of the invention.

Although the invention has been described in terms of certain preferred embodiments, it will become apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. An apparatus for removing debris from downhole in a wellbore to the surface, comprising:

a housing moveable within the wellbore to a location proximate to the debris;

a chamber within said housing for receiving the debris, said chamber having a pressurized liquid therein;

a valve for selectively releasing the pressurized liquid from said chamber to draw the debris into said chamber; and a wireline for moving said housing, chamber, and debris to the wellbore surface.

2. An apparatus as recited in claim 1, further comprising a retainer valve for retaining the debris within said chamber as said housing, chamber, and debris is moved to the wellbore surface.

3. An apparatus as recited in claim 1, wherein said chamber further comprises a piston moveable within said chamber, said pressurized liquid initially holding said piston stationary relative to said chamber, and said valve for selectively releasing said pressurized liquid to permit movement of said piston within said chamber.

4. An apparatus as recited in claim 3, further comprising a second chamber for capturing said liquid as said liquid is released from said chamber.

5. An apparatus as recited in claim 4, further comprising a second piston within said second chamber which is moveable by said liquid.

6. An apparatus as recited in claim 1, further comprising a port for selectively introducing liquid into said chamber.

7. An apparatus for removing debris from downhole in a wellbore to the surface, comprising:

a housing moveable within the wellbore to a location proximate to the debris;

a first chamber within said housing for receiving the debris;

a pressurized liquid within said first chamber;

a second chamber within said housing;

a valve for selectively releasing said pressurized liquid from said first chamber into to said second chamber for drawing the debris into said first chamber; and means for moving said housing, chamber, and debris to the wellbore surface.

8. An apparatus as recited in claim 7, further comprising a first piston in said first chamber which is moveable by the release of said pressurized fluid from said first chamber to draw debris into said first chamber.

9. An apparatus as recited in claim 8, further comprising a second piston in said second chamber which is moveable by the release of said pressurized fluid from said first chamber.

10. An apparatus as recited in claim 9, wherein said second piston is selectively moveable to return said fluid to said first chamber after the debris is removed from said first chamber.

11. An apparatus as recited in claim 7, further comprising a tube connecting said first and second chambers for conveying said pressurized fluid therebetween.

12. A method for removing debris from downhole in a wellbore to the surface, comprising the steps of:

lowering a housing within the wellbore to a location proximate to the debris, wherein said housing includes a chamber for receiving the debris, said chamber initially having pressurized liquid therein;

operating a valve in contact with said liquid to reduce the pressure within said chamber and to draw the debris into said chamber; and raising said housing and debris to the wellbore surface.

13. A method as recited in claim 12 further comprising a piston in said chamber for separating said liquid and the debris.

14. A method as recited in claim 13, further comprising the steps of operating said valve to move said liquid from said first chamber into a second chamber and of retaining said liquid in said second chamber as debris is drawn into said first chamber.

15. A method as recited in claim 12 further comprising the steps of placing said liquid into said chamber and of pressurizing said liquid.

16. A method as recited in claim 15, wherein said liquid is pressurized by lowering said housing into the wellbore.

* * * * *